US005088995A

United States Patent [19]

Packard et al.

[11] Patent Number: 5,088,995

[45] Date of Patent: Feb. 18, 1992

[54] PORT AND CLOSURE ASSEMBLY INCLUDING A RESEALING INJECTION SITE FOR A CONTAINER

[75] Inventors: Jeffrey Packard, Grayslake; William J. Schnell, Libertyville; Michael W. Scharf, McHenry, all of Ill.

[73] Assignee: Baxter International Inc., Deerfield, Ill.

[21] Appl. No.: 542,385

[22] Filed: Jun. 22, 1990

[51] Int. Cl.[5] ..... B65D 41/50

[52] U.S. Cl. ..... 604/415; 604/905; 604/408; 215/247

[58] Field of Search ..... 215/247, 249; 604/408, 604/409, 410, 415, 905

[56] References Cited

U.S. PATENT DOCUMENTS

| | | | |
|---|---|---|---|
| D. 280,764 | 9/1985 | Boarini . | |
| 3,030,955 | 4/1962 | Gossett et al. . | |
| 3,105,613 | 10/1963 | Barton et al. . | |
| 3,136,440 | 6/1964 | Krug et al. . | |
| 3,241,663 | 3/1966 | Kaepernik . | |
| 3,379,326 | 4/1968 | Andersen . | |
| 3,850,202 | 11/1974 | Morgan . | |
| 3,900,028 | 8/1975 | McPhee . | |
| 3,990,445 | 11/1976 | Lundquist . | |
| 4,048,995 | 9/1977 | Mittleman . | |
| 4,048,996 | 9/1977 | Mittleman et al. . | |
| 4,133,441 | 1/1979 | Mittleman et al. . | |
| 4,180,173 | 12/1979 | Diaz . | |
| 4,219,912 | 9/1980 | Adams . | |
| 4,294,249 | 10/1981 | Sheehan et al. . | |
| 4,301,590 | 11/1981 | Ward . | |
| 4,301,936 | 11/1981 | Percarpio | 215/247 |
| 4,303,067 | 12/1981 | Connolly et al. . | |
| 4,307,766 | 12/1981 | Tanokura | 215/247 X |
| 4,393,909 | 7/1983 | Pearson . | |
| 4,405,316 | 9/1983 | Mittleman . | |
| 4,412,573 | 11/1983 | Zdeb | 604/415 |
| 4,430,077 | 2/1984 | Mittleman et al. . | |
| 4,479,989 | 10/1984 | Mahal . | |
| 4,547,900 | 10/1985 | Larkin et al. | 604/408 X |
| 4,632,267 | 12/1986 | Fowles et al. | 215/253 |
| 4,698,061 | 10/1987 | Makaryk et al. | 604/408 |
| 4,874,369 | 10/1989 | Kulle et al. . | |
| 4,878,897 | 11/1989 | Katzin . | |
| 4,892,222 | 1/1990 | Schmidt et al. . | |
| 4,903,855 | 2/1990 | Ducay et al. | 215/249 X |
| 4,910,147 | 3/1990 | Bacehowski | 435/296 |

*Primary Examiner*—Robert A. Hafer
*Assistant Examiner*—Kerry Owens
*Attorney, Agent, or Firm*—Paul C. Flattery; Amy L. H. Rockwell; Paul E. Schaafsma

[57] ABSTRACT

A port and closure assembly for a container is provided. The port and closure assembly includes a port having a tubular portion that extends from a base and terminates at an end including an opening. The tubular portion is divided into an upper and lower section by a pierceable membrane. The upper section including an end that terminates at the opening and including a resealing injection site. A closure member for removably surrounding at least a portion of the end of the port including the opening is provided. The closure includes a sleeve that circumscribes at least a portion of an outer surface of the upper section of the tubular portion. The sleeve is so constructed and arranged as to cause portions of the upper section to contact the resealing member during a sterilization step that softens the portions and further causes the portions of the upper section to retain the resealing injection site within the tubular portion after the portions have hardened.

16 Claims, 1 Drawing Sheet

PORT AND CLOSURE ASSEMBLY INCLUDING A RESEALING INJECTION SITE FOR A CONTAINER

BACKGROUND OF THE INVENTION

The present invention relates generally to a port and closure assembly for a container. More specifically, the present invention relates to a port and closure assembly including a resealing injection site for accessing a container.

Ports are utilized to access material packaged within a container. As used herein, the term "ports" includes, without limitation, fitments, valves, and other means for accessing a container. In the medical industry, parenteral, enteral, and peritoneal dialysis solutions are packaged in flexible containers that are accessed via a port. An example of such a flexible container is the VIAFLEX® collapsible plastic container sold by Baxter Healthcare Corporation of Deerfield, Ill.

The port can function not only to provide means for accessing the solution contained within the container, but can also provide a site for the injection of material into the container. For example, it may be desirable to inject a medicament into a dextrose or saline solution, and then administer the resultant product intravenously into a patient. Such an injection site, however, must be so constructed that it is resealing so that contamination of the resultant product is prevented and the resultant product does not leak out of the injection port.

Typically, the port assembly comprises a tubular structure having an inner bore that extends from a base that is secured to the container. Located within the bore, typically, is a needle pierceable membrane or wall that provides a barrier between the fluid contained within the container and the outside environment. Usually, pointed means that pierce the pierceable wall, are used to gain access to the container and thereby the fluid housed therein. To guard against contamination at the port, closures are utilized for covering the opening of the port.

Although port assemblies having resealing injection sites are known, these port assemblies have not been entirely satisfactory. Some of the problems of the prior port assemblies relate to the manufacturing process and the failure of the injection site to be sufficiently secured within the port or port assembly. The manufacturing process by which the injection site is secured within the port may result in a time and/or cost intensive procedure.

There is therefore a need for an improved port and closure assembly having a resealing injection site.

SUMMARY OF THE INVENTION

The present invention provides an improved port and closure assembly including a resealing injection site for use with a container to access fluid housed within the container. The present invention also provides an improved container having a port and closure assembly. Further, the present invention provides a method for manufacturing a port and closure assembly.

In an embodiment, the present invention provides a port for a container. The port includes a tubular portion that extends from a base, the tubular portion terminating at an end that includes an opening. A resealing injection site is located within the tubular bore. Means circumscribing an outer surface of the tubular portion are provided for causing at least a portion of the tubular portion to be urged against the resealing injection site when the tubular portion is caused to soften during a sterilization step. The means circumscribing the tubular portion causes the resealing injection site to be secured within the tubular portion of the port.

In an embodiment, a port and closure assembly for a container is provided. The port and closure assembly comprises a port including a tubular portion that extends from a base and terminates at an end including an opening. The tubular portion is divided into an upper and lower section by a membrane. The upper section including an end that terminates at the opening and including a resealing injection site. A closure member for removably surrounding at least a portion of the end of the port including the opening is provided. The closure includes a sleeve that circumscribes at least a portion of an outer surface of the upper section of the tubular portion. The sleeve is so constructed and arranged as to cause portions of the upper section to contact the resealing member during a sterilization step that softens the portions and further causes the portions of the upper section to retain the resealing injection site within the tubular portion after the portions have hardened.

In an embodiment, the upper end of the resealing injection site includes an undercut portion. In a further embodiment, the resealing injection site includes an upper and lower end, the lower end resting on a portion of the surface of the tubular portion that defines the membrane and including a cut-out portion.

In an embodiment, the closure includes a first elongated end for gripping the closure that is removably secured to the sleeve allowing the first elongated end to be separate from the sleeve upon the application of a sufficient pulling force.

The present invention also provides a method for producing a port and closure assembly for a container. The method includes the steps of providing a port including a tubular member that defines a tubular bore and placing a resealing injection site within the tubular bore. A closure, including a sleeve, is located on the port so that at least a portion of the tubular member surrounding the resealing injection site is surrounded by the sleeve. The tubular member is caused to be softened so as to cause at least portions of the tubular member surrounding the resealing injection site to be urged against the resealing injection site. And allowing the tubular member to harden while urging portions thereof against the resealing injection site, thereby securing the resealing injection site within the tubular member.

An advantage of the present invention is that it provides an improved port including a resealing injection site.

Furthermore, an advantage of the present invention is that it provides an improved port and closure for a flexible container.

Still, an advantage of the present invention is that it provides an improved method of manufacturing a port including a resealing injection site.

Still, an advantage of the present invention is that it provides a port and closure assembly wherein a resealing injection site is securely located within the port.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an improved port and closure assembly for a container as well as a method for making same and a container having same. The port provides a means for accessing the container. To this end, the port can provide a means for injecting into the container a substance or withdrawing therefrom the contents of the container. The container can be any container known in the art. However, the present invention is particularly directed to use with a container for housings solutions in the medical industry, these fluids should be maintained and extracted under sterile conditions. Furthermore, the invention is particularly useful with containers constructed from flexible materials such as the VIAFLEX® container.

Figure 1:
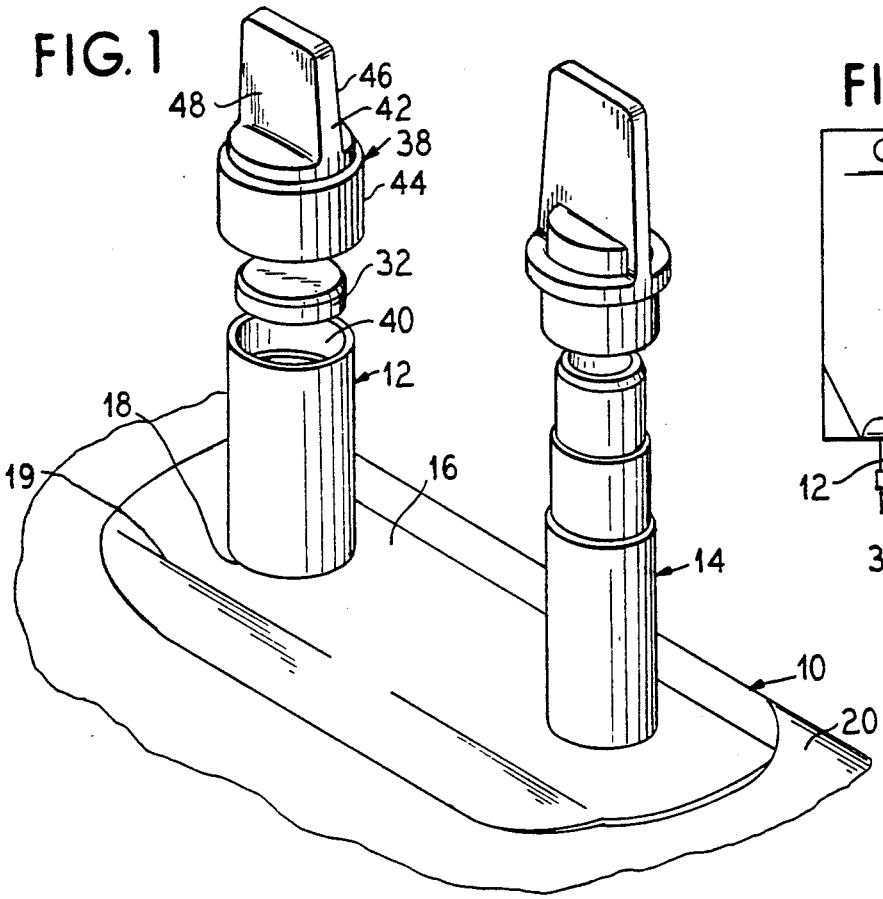
FIG. 1 illustrates an exploded perspective view of an embodiment of the port assembly of the present invention.

Referring now to FIG. 1, the port assembly 10 of the present invention is illustrated. As illustrated, the port assembly 10 includes an injection port 12, an administration port 14, and a case 16. If desirable, the injection port 12 can be used alone or with more than one additional port.

The injection port 12 and administration port 14 include openings 18 and 21 that allow the ports to be in fluid communication with the contents of the container 20. The injection port 12 functions as an injection site for injecting a medicament into the container. The administration port 14 functions to allow the fluid in the container to be dispensed. Because the administration port 14 functions to provide a means for accessing the contents of the container 20, the administration port 14 is so constructed and arranged that it can receive a spike portion of an administration set. This allows the contents of the container 20 to be, for example, intravenously administered to a patient.

Figure 2:
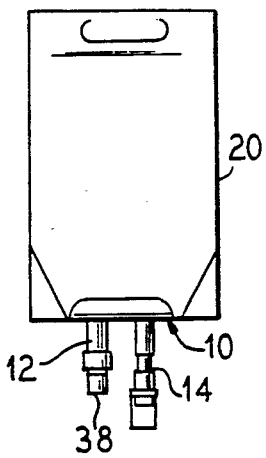
FIG. 2 illustrates a container including the port assembly of the present invention.

Preferably, the base 16 of the port assembly 10 is secured to a container 20, such as a flexible bag 20. FIG. 2 illustrates a flexible bag 20 including the port assembly 10 of the present invention. In the preferred embodiment of the invention illustrated, the base 10 is not planar but instead includes curved portions 19. The curved portions 19 function to improve delivery of the product housed within the container 20 to the ports.

Figure 3:
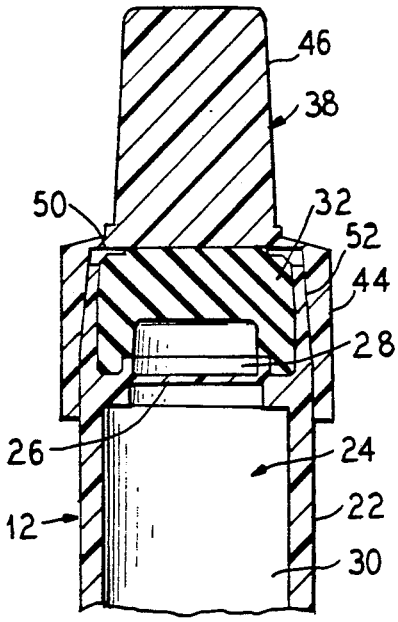
FIG. 3 illustrates a cross-sectional view of the injection port of the port assembly of FIG. 1.

Referring now to FIG. 3, the injection port 12 includes a tubular wall 22 that defines a tubular bore 24. Located within the tubular bore 24 is a pierceable membrane 26. The pierceable membrane 26 divides the tubular bore 24 into an upper portion 28 and a lower portion 30.

Located within the upper portion 28 of the tubular bore 24 is a resealing injection site 32. The resealing injection site 32 allows the injection of a substance, for example, a drug, through the injection port into the container 20 to which the port assembly 10 is secured. Because the injection site 32 is resealing, the injection site 32 functions to provide a seal after the injection of a drug into the container. This has principally two functions: 1) to prevent microbial ingress into the container 20 through the injection port 12; and 2) to prevent leakage of the resultant product contained in the container 20 through the injection port 12.

The resealing injection site 32 is preferably constructed from an elastomeric material. In a preferred embodiment, the resealing injection site 32 is constructed from a natural rubber.

The port assembly 10 includes a closure 38. The closure 38 functions, in part, to cover the opening 40 of the injection port 12. Accordingly, when the port and closure assembly 10 is sterilized, the closure 38 will insure a sterile environment until it is necessary to access the container.

Figure 4:
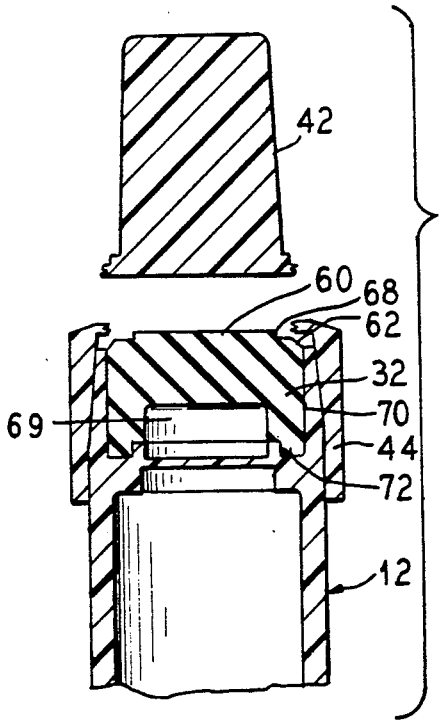
FIG. 4 illustrates a cross-sectional view of the injection port of the port assembly of FIG. illustrating the separation of the top portion of the closure from the sleeve member.

The closure 38 includes an elongated gripping member 42 and a sleeve member 44. The elongated gripping member includes surfaces 46 and 48 that allow it to be gripped by one's fingers. The elongated gripping member 42 and sleeve 44 are secured to each other by a web of material 50. The web of material 50 preferably is constructed so that the elongated gripping member 42 will break away from the sleeve member 44 upon the application of a sufficient pulling force; this is illustrated in FIG. 4. To this end, the web of material 50 can either be scored or of a reduced cross-sectional thickness. By allowing the elongated gripping member 42 to be removed from the sleeve member 44, this provides access to the resealing injection site 32.

When positioned on the injection port 12, the sleeve 44 of the closure 38 circumscribes a portion 52 of the tubular wall 22 that surrounds the resealing injection site 32. This construction provides the port and closure assembly 10 means for securing the resealing injection site 32 within the tubular bore 24. The sleeve 44 is so constructed and arranged so as to exert a diametric force on the portion 52 of the tubular wall 22 which is surrounded by the sleeve.

Pursuant to an embodiment of the present invention, after the resealing injection site 32 is placed within the tubular bore 24, the closure member 38 is positioned thereover. The tubular wall 22 is then softened by a sterilization process, autoclaving, or other step. Due to the construction of the sleeve 44, when the tubular wall 22 is so softened, the sleeve 44 causes the tubular wall 22 to be biased against the resealable injection site 32. The tubular wall 22 is then allowed to cool and thereby harden securing the resealing injection site 32 within the injection port 12.

Pursuant to the present invention, a sterile seal is created that locks the resealing injection site 32 within the tubular bore 24 of the injection port 12. The injection site 32 is locked in place due to the deformation of the port walls that surround the resealing injection site during the sterilization .cycle. The present invention eliminates the need for bonding or additional mechanical operation to secure the resealing injection site 32 within the port 12.

The tubular wall of the injection port 12 is constructed from a material that will soften at elevated temperatures and conform to the sides of the resealing injection site 32. For example, the tubular wall preferably is constructed from a material that will soften at temperatures typically used to sterilize fitments in an autoclave.

As illustrated in the figures, the resealing injection site 32 includes a top surface 60 and an undercut portion 62. The undercut portion 62 is defined by a draft angle that provides a more secure fit within the tubular member and functions to secure the resealing injection site in place.

Preferably, the top surface 60 of the resealing injection site 32 includes a target ring 68. The target ring 68 assists the doctor or nurse in properly injecting the injection port 12 in the correct location. Although the top surface 60 preferably includes a target ring 68, it is substantially flat to aid in swabbing and to prevent a pooling of alcohol.

The resealing injection site 32 also includes a cut-out portion 69 at a bottom surface 70 thereof. The cut-out portion 69 is defined by extended portions 72 of the resealing injection site 32. These extended portions 72 preferably rest on a bottom of the tubular member that defines the pierceable membrane 26 of the port. The cut-out portion 69 allows the resealing injection site 32 to deflect during injection. This assists in eliminating coring. Preferably, the cut-out portion 69 has a circular cross-sectional shape. However, the cut-out portion can have other shapes and constructions.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A port and closure assembly for a container comprising:

a port including a tubular portion that extends from a base and terminates at an end including an opening, the tubular portion being divided into an upper and lower section by a pierceable membrane, the upper section including the end that terminates in the opening and including a resealing injection site; and a closure member for removably covering at least a portion of the end including the opening and including a lower sleeve that circumscribes at least a portion of an outer surface of the upper section of the tubular portion, the lower sleeve causing portions of the upper section to contact the resealing injection site during a sterilization step that softens the upper section and causing the portions of the upper section to retain the resealing injection site within the tubular portion after the upper section hardens.

2. The port and closure of claim 1 wherein an upper end of the resealing injection site includes an undercut portion.

3. The port and closure of claim 1 wherein the resealing injection site includes an upper and lower end, the lower end resting on a portion of a surface of the tubular portion that defines the pierceable membrane, the lower end including a cut-out portion.

4. The port and closure of claim 3 wherein the cut-out portion has a substantially circular cross-sectional shape.

5. The port and closure assembly of claim 1 including a second tubular member extending from the base.

6. The port and closure assembly of claim 1 wherein the closure includes a first elongated end for gripping the closure that is removably secured to the lower sleeve allowing the first elongated end to be separated from the sleeve upon the application of a sufficient pulling force.

7. A container including a port for accessing the contents of the container and a closure for removably covering an opening defined by the port comprising:

a port including a tubular portion that extends from a base and terminates at an end including an opening, the tubular portion being divided into an upper and lower section by a pierceable wall, the upper section including the end that terminates in the opening and including a resealing injection site; and a closure member for removably covering at least a portion of the end including the opening and including a lower sleeve that circumscribes at least a portion of an outer surface of the upper section of the tubular portion, the lower sleeve causing portions of the upper section to contact the resealing injection site upon the application of sufficient heat to soften the upper section.

8. The container of claim 7 wherein an upper end of the resealing injection site includes an undercut portion.

9. The container of claim 7 wherein the resealing injection site includes an upper and lower end, the lower end resting on a portion of a surface of the tubular portion that defines the pierceable wall, the lower end including a cut-out portion.

10. The container of claim 9 wherein the cut-out portion has a substantially circular cross-sectional shape.

11. The container of claim 7 wherein the closure includes a first elongated end for gripping the closure that is removably secured to the lower sleeve allowing the first elongated end to be separated from the sleeve upon the application of a sufficient pulling force.

12. The container of claim 7 wherein the port includes a second tubular portion that extends from the base.

13. A method for producing a port and closure assembly for a container comprising the steps of:

providing a port including a tubular bore defined by a tubular wall;

placing a resealing injection site within the tubular bore of the port;

locating a closure including a sleeve on the port so that at least a portion of the tubular wall surrounding the resealing injection site is surrounded by the sleeve;

causing the tubular wall to soften so as to cause at least portions of the tubular wall surrounding the resealing injection site to be urged against the resealing injection site by the sleeve; and allowing the tubular wall to harden.

14. The method of claim 13 wherein the tubular wall is caused to soften by a sterilization process.

15. The method of claim 13 wherein the tubular wall is caused to soften by autoclaving.

16. A port and closure assembly for a container comprising:

a port including a tubular portion that extends from a base and terminates at an end including an opening, the tubular portion being divided into an upper and lower section by a pierceable membrane, the upper section including the end that terminates in the opening and including a resealing injection side the resealing injection site includes a top surface having a target ring; and a closure member for removably covering at least a portion of the end including the opening and including a lower sleeve that circumscribes at least a portion of an outer surface of the upper section of the tubular portion, the lower sleeve causing portions of the upper section to contact the resealing injection site during a sterilization step that softens the upper section and causing the portions of the upper section to retain the resealing injection site within the tubular portion after the upper section hardens.

* * * * *

UNITED STATES PATENT AND TRADEMARK OFFICE

CERTIFICATE OF CORRECTION

PATENT NO. : 5,088,995

DATED : February 18, 1992

INVENTOR(S) : Jeffrey Packard; William J. Schnell; Michael W. Scharf

It is certified that error appears in the above-identified patent and that said Letters Patent is hereby corrected as shown below:

In the section entitled "Brief Description of the Drawings," in column 3, line 11, the text incorrectly reads "port assembly of FIG. illustrating...;" it should read ---port assembly of FIG. 1 illustrating---.

In column 6, line 66, the word "side" is incorrect; the word should be ---site---.

Signed and Sealed this

Eighth Day of June, 1993

*Attest:*

Michael K. Kirk

MICHAEL K. KIRK

*Attesting Officer*

*Acting Commissioner of Patents and Trademarks*